US005960710A

United States Patent [19]

Holtom

[11] Patent Number: 5,960,710

[45] Date of Patent: Oct. 5, 1999

[54] REFUSE COMPACTOR

[75] Inventor: Stephen Wayne Holtom, Greystanes, Australia

[73] Assignee: Farnow Pty Limited, Greystanes, Australia

[21] Appl. No.: 08/930,896

[22] PCT Filed: Apr. 4, 1996

[86] PCT No.: PCT/AU96/00205

§ 371 Date: Jan. 26, 1998

§ 102(e) Date: Jan. 26, 1998

[87] PCT Pub. No.: WO96/31416

PCT Pub. Date: Oct. 10, 1996

[30] Foreign Application Priority Data

Apr. 4, 1995 [AU] Australia ..... PN2147

[51] Int. Cl.[6] ..... B30B 9/30; B65F 1/14

[52] U.S. Cl. ..... 100/53; 100/100; 100/226; 100/233

[58] Field of Search ..... 100/53, 100, 226–228, 100/229 A, 233, 245, 253, 271

[56] References Cited

U.S. PATENT DOCUMENTS

| | | | |
|---|---|---|---|
| 3,412,532 | 11/1968 | Nickla | 100/233 |
| 3,903,461 | 9/1975 | Waggoner | 100/233 |
| 3,961,573 | 6/1976 | Schmidt | 100/233 |
| 4,152,979 | 5/1979 | Schmidt | 100/233 |
| 4,155,297 | 5/1979 | Smith et al. | 100/233 |
| 4,164,178 | 8/1979 | Baumann et al. . | |
| 4,183,295 | 1/1980 | Peterson | 100/233 |
| 4,286,515 | 9/1981 | Baumann et al. . | |
| 4,290,352 | 9/1981 | Schmidt et al. | 100/233 |

FOREIGN PATENT DOCUMENTS

| | | | |
|---|---|---|---|
| 19577/92 | 1/1993 | Australia . | |
| 283362 | 2/1980 | Germany . | |
| 3142218 | 5/1983 | Germany . | |
| 3338213 | 6/1984 | Germany . | |
| 4013107 | 10/1991 | Germany . | |
| 4226978 | 2/1994 | Germany . | |
| 596980 | 3/1978 | Switzerland | 100/233 |

*Primary Examiner*—Stephen F. Gerrity
*Attorney, Agent, or Firm*—Abelman, Frayne & Schwab

[57] ABSTRACT

A refuse compactor (10) has a storage or compaction chamber (11), a lid (12) and a compaction blade (13). The compaction blade (13) is driven by cylinder (18) which may be attached to either the lid (12) or the chamber (11).

8 Claims, 10 Drawing Sheets

REFUSE COMPACTOR

FIELD OF INVENTION

This invention relates to refuse compactors and more particularly to a small self-contained compaction unit which is designed to be emptied by a conventional front-loading or rear-loading compactor vehicle.

BACKGROUND ART

The waste industry is always looking for ways to improve the volumeric efficiency and environmental integrity of waste storage containers while reducing overall costs. The simplest way to improve the volumeric efficiency of a storage container is to compact the waste mechanically inside the container, thereby increasing the density of the waste.

Current designs of front-loading or rear-loading containers can only have their contents compacted by coupling the container to a separate, fixed compaction head. This system has several disadvantages including high spillage and leakage rates during the separation and discharge operations. Furthermore, the compaction head must be permanently fixed to the ground thereby limiting its versatility and requiring the assignment of a permanent designated access area.

Another problem encountered by waste authorities is that in high density applications such as the cities of Europe, Asia and The Middle East the space and access restrictions caused by narrow streets and parked vehicles are such that conventional compactor vehicles cannot get close enough to the waste product to operate efficiently. The current solution to this problem is the use of high numbers of collectors who push hand-carts through the streets manually loading the waste product and returning to a central collection point where they wait for a truck mounted compactor. At this stage the waste product is transferred from the cart to the compactor and the collector resumes the run with his empty cart. Although this system may be acceptable when labour rates were very low, spiralling labour costs demand that an effective alternative be found.

SUMMARY OF INVENTION

According to the present invention there is provided a refuse compactor comprising a storage chamber or container having an opening thereto, a lid for closing the opening and a compaction blade arranged to compact the waste material within the storage chamber or container.

Figure 1:
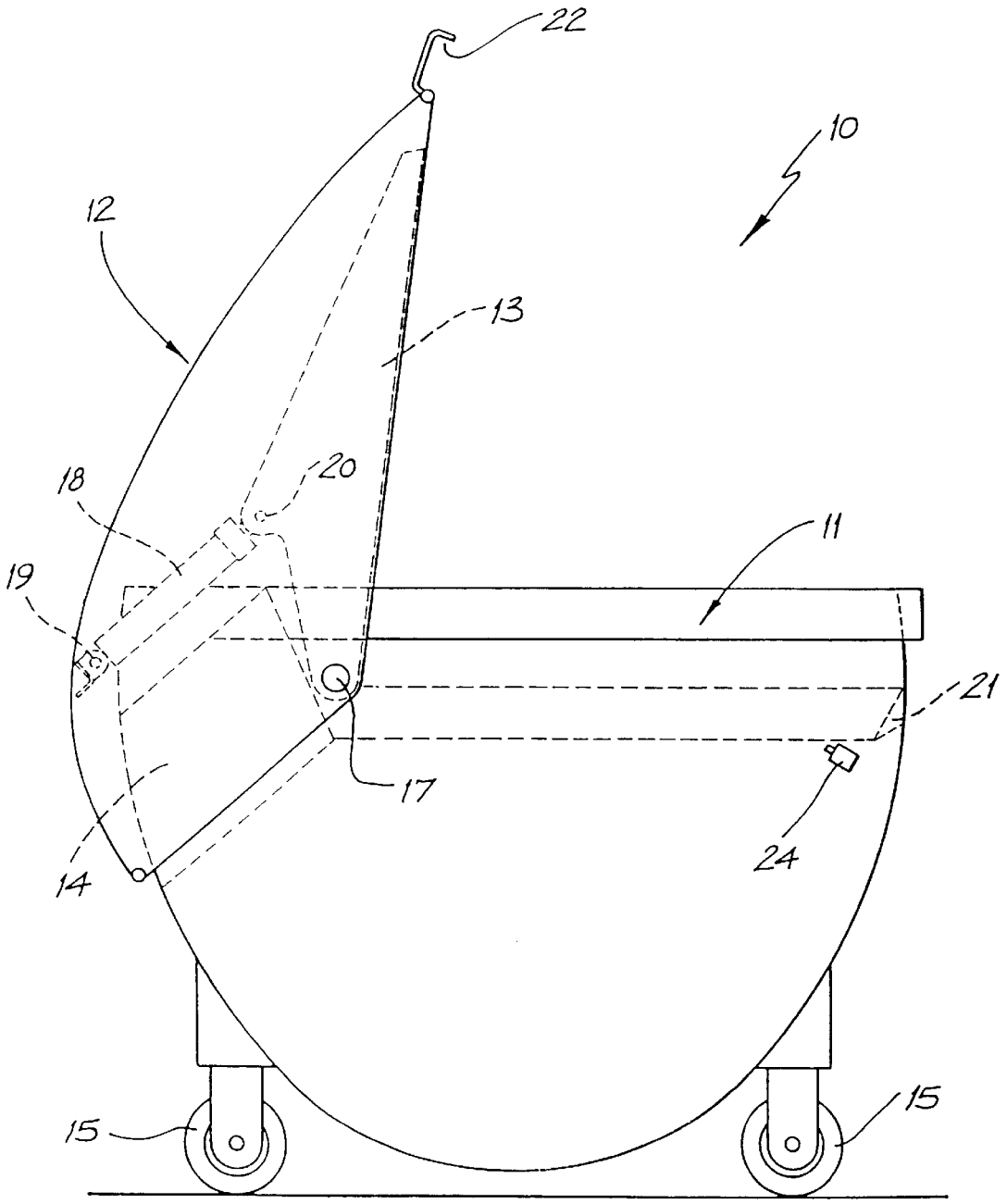
FIG. 1 is a side elevational view of a refuse compactor according to one embodiment of the invention with the lid open.
Figure 2:
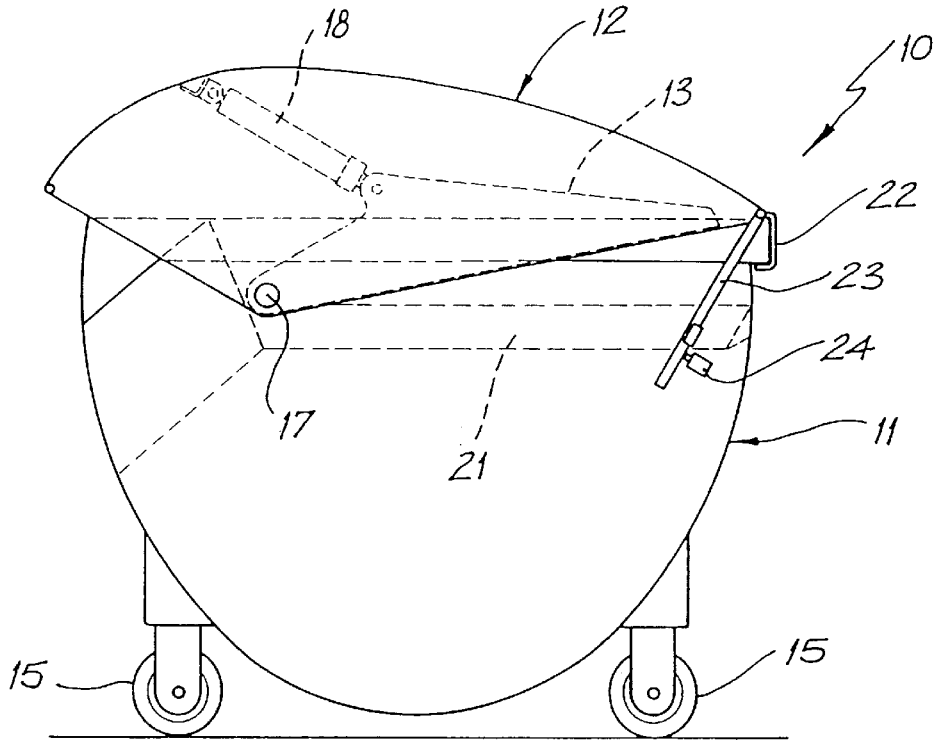
FIG. 2 is a view similar to FIG. 1 with the lid closed.
Figure 3:
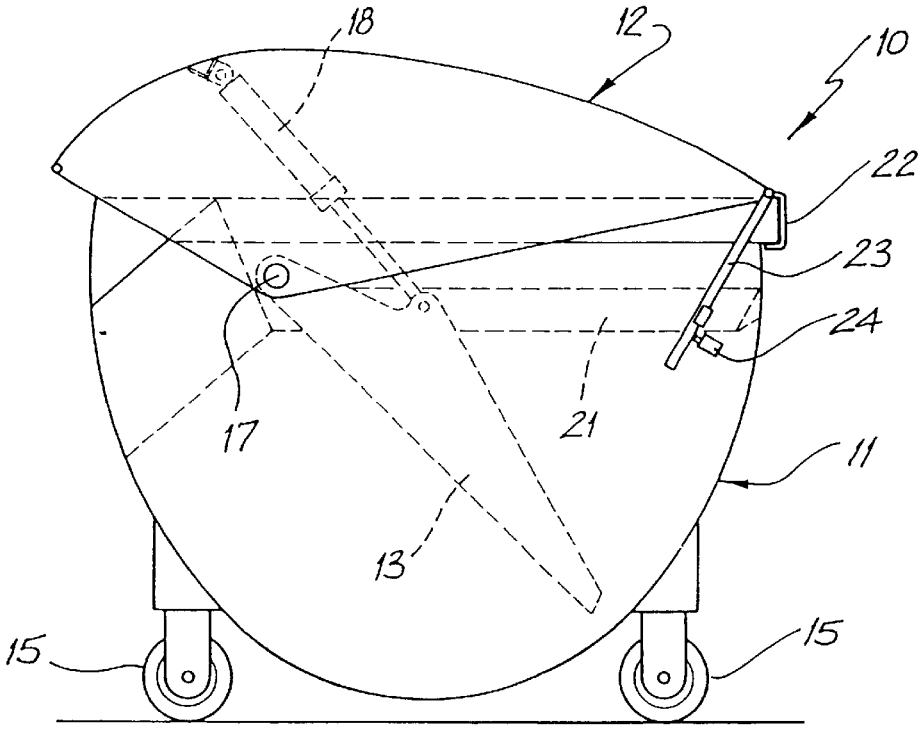
FIG. 3 is a view similar to FIG. 2 with the compaction blade in operation.
Figure 4:
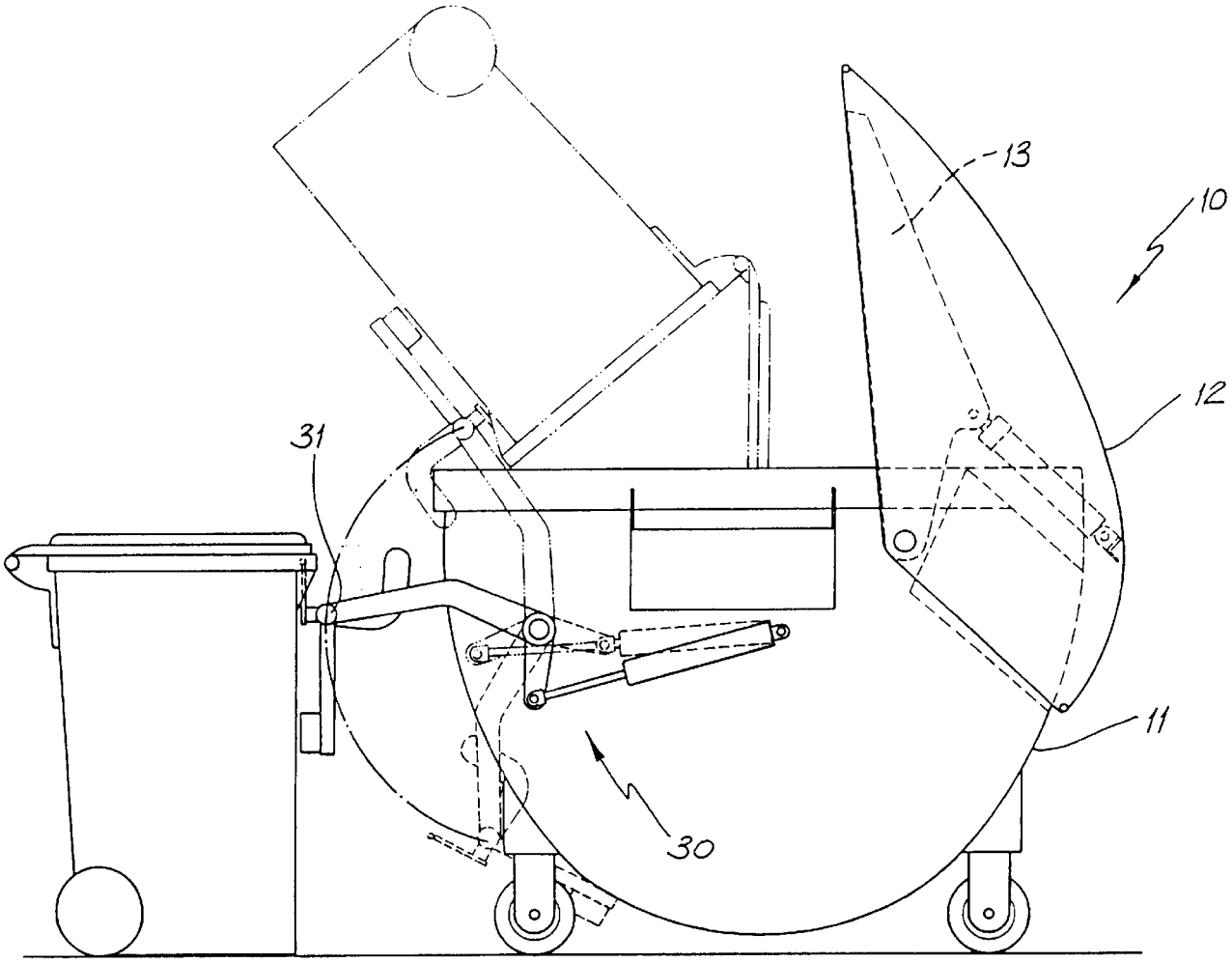
FIG. 4 is a side elevational view of the compactor shown in FIG. 1 from the other side showing a bin unloading mechanism.

The refuse compactor 10 shown in FIGS. 1 to 5 includes a storage container 11, a lid 12, a compaction blade 13 and a self-contained power unit 14.

The storage container 11, in this instance is nominally of 3 cubic metre capacity and is formed into a semicircular shape with flat sides from light gauge sheet steel and then fully welded to provide a totally leak-proof container.

The semicircular shape eliminates square corners where waste product can stick and generate rust. The shape also simplifies the construction, reduces the number of welds and thereby significantly improves the manufacturing costs.

A set of castor type wheels 15 are fitted to the base of the storage container to allow the unit to be moved around.

Figure 5:
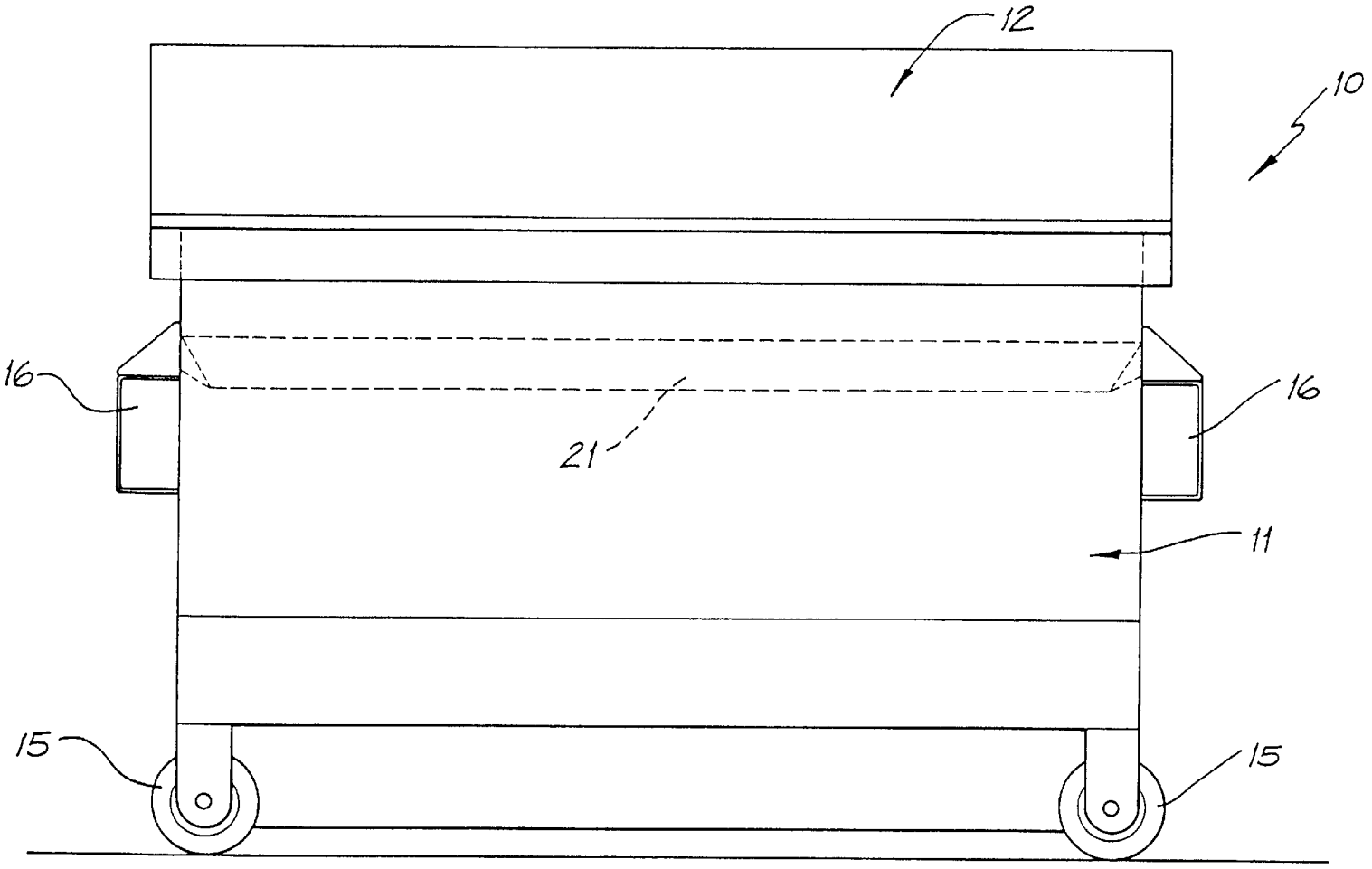
FIG. 5 is a front view of the compactor shown in FIG. 1.
Figure 6:
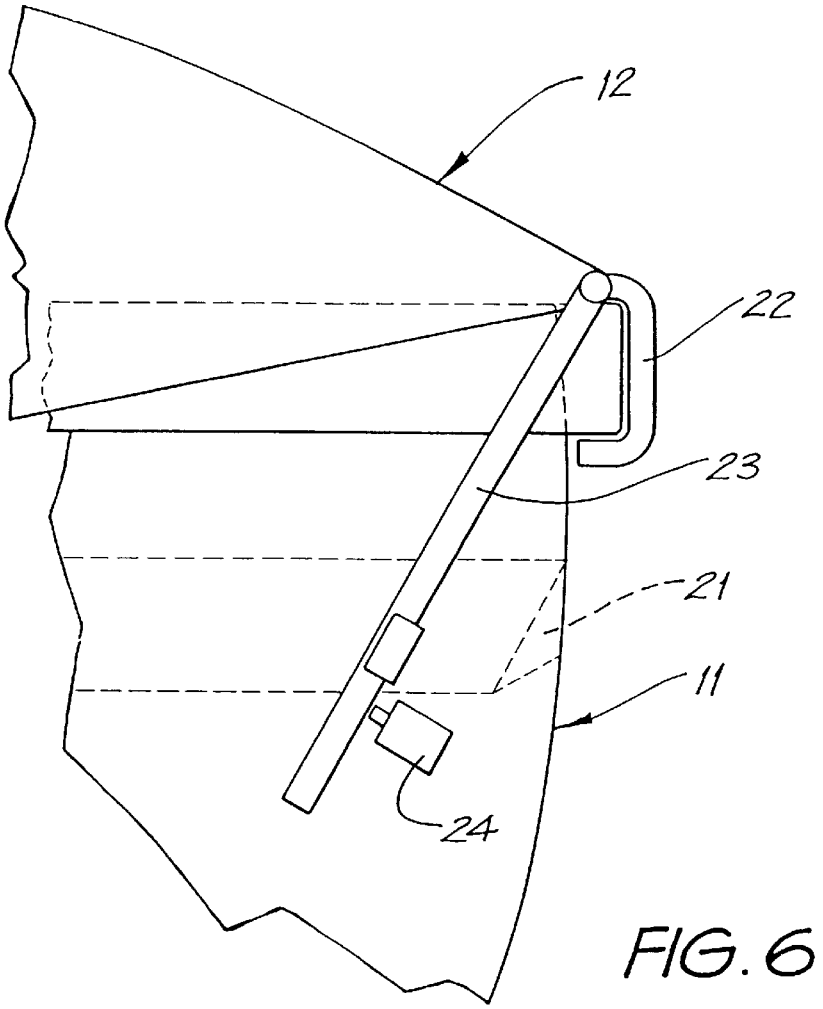
FIG. 6 is an enlarged view of the locking mechanism shown in FIGS. 1 to 3.

As can be seen in FIG. 5 a pair of lifting sockets 16 or equivalent applicable attachments is provided to allow the unit to be lifted for discharge and/or transportation.

The lid 12 of the compactor 10 is constructed from a formed, light gauge, sheet steel and is pivoted about an axle 17 which runs the full width of the container. The unit is well balanced which allows the entire assembly to be opened and closed manually.

Housed inside the lid 12 is the compaction blade 13 which is fabricated from reinforced, pressed sheet steel. The blade 13 which also pivots around the full width axle 17, is driven through an arc of travel of about 90 degrees by means of twin, double acting, hydraulic cylinders 18 which are attached to the inside of the lid at point 19 and to the blade 13 at point 20. This action compacts the waste product inside the container to a nominal ratio of 4 to 1, thereby providing an equivalent to 12 cubic metres of waste storage.

Figure 7:
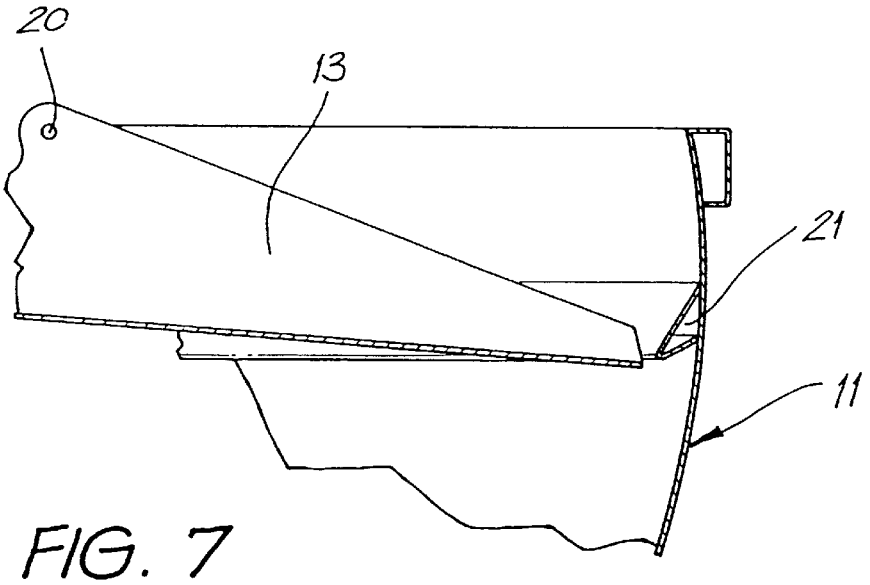
FIG. 7 is an enlarged view of the compactor blade and cutter bar shown in FIGS. 2 and 3.
Figure 8:
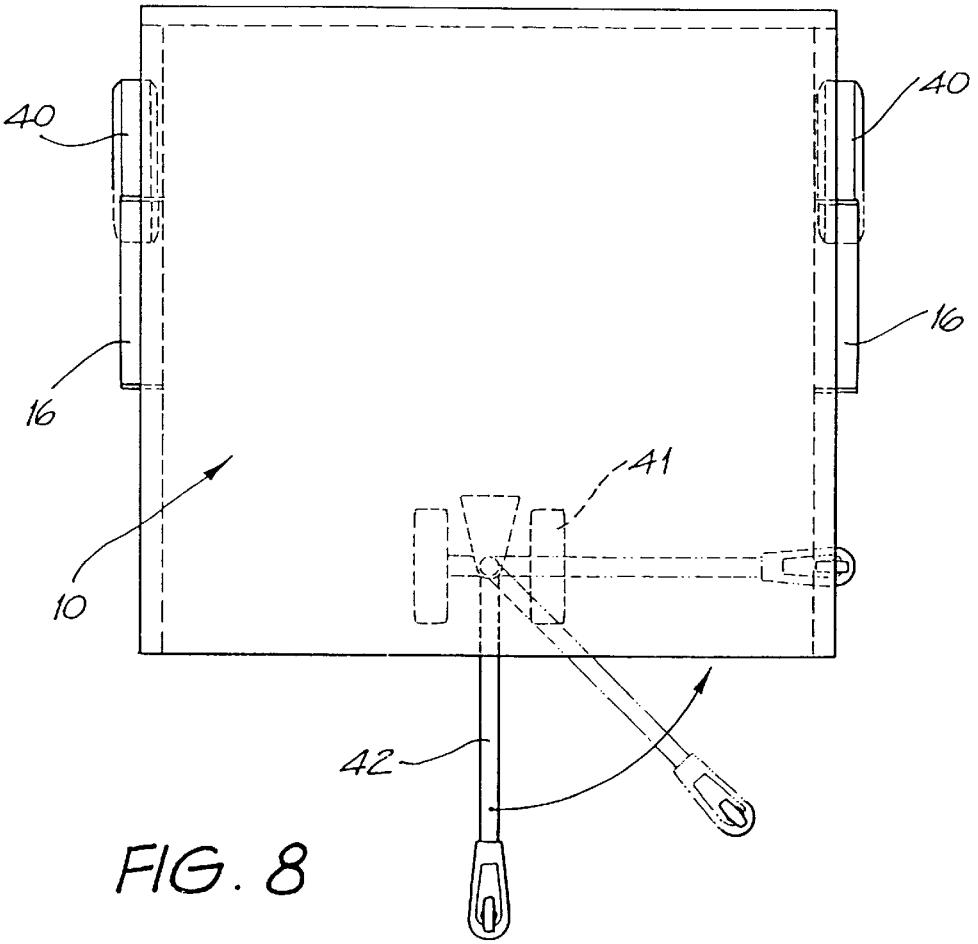
FIG. 8 is a plan view of a refuse compactor according to a second embodiment of the invention.
Figure 9:
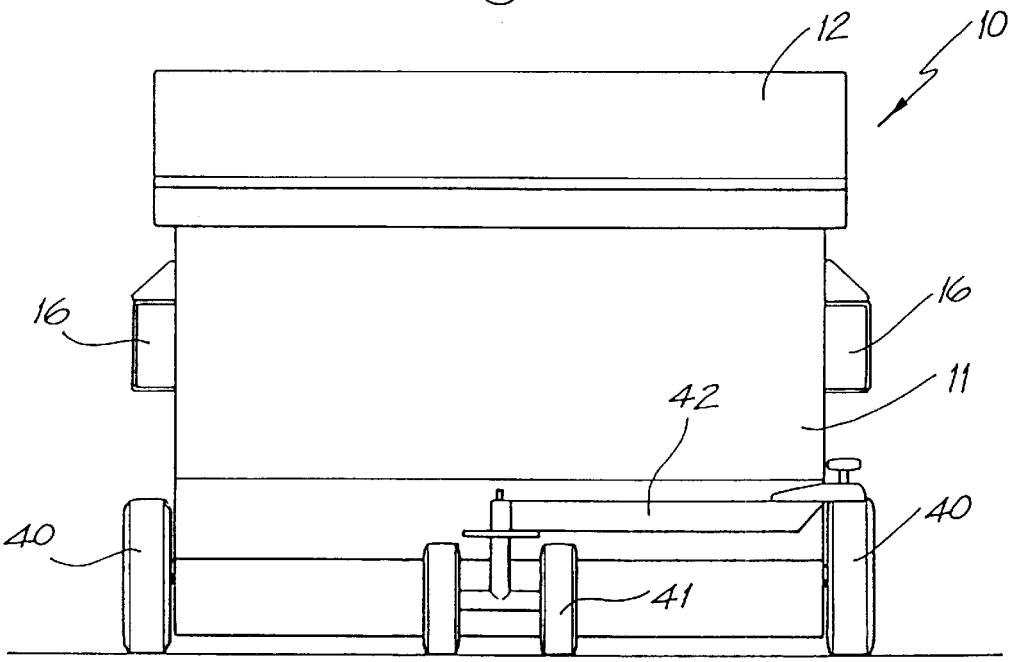
FIG. 9 is a front view of the refuse compactor shown in FIG. 8.
Figure 10:
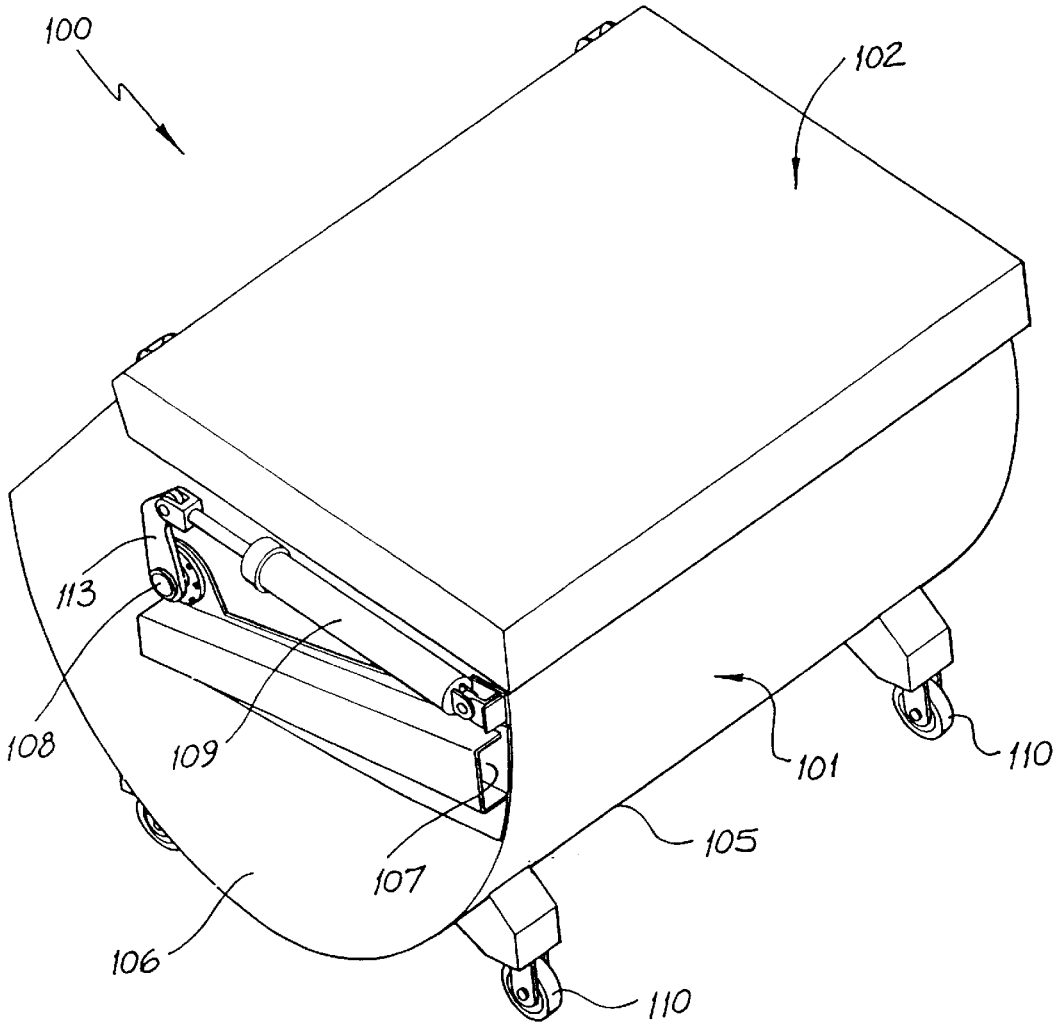
FIG. 10 is a perspective view of a refuse compactor according to a second embodiment of the invention with the lid closed.
Figure 11:
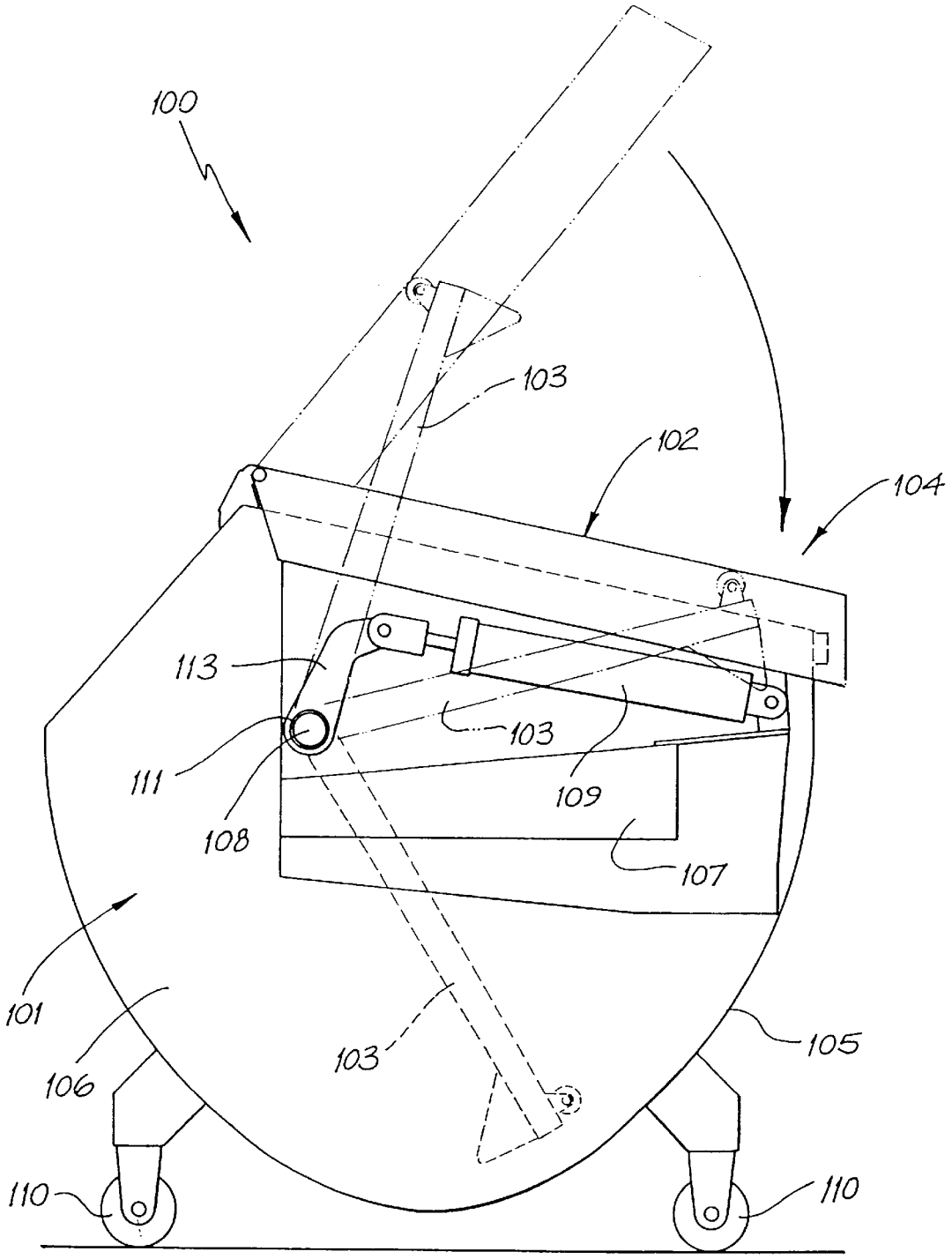
FIG. 11 is a side elevational view of the compactor shown in FIG. 10 with the lid open.
Figure 12:
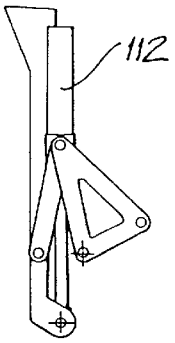
FIGS. 12 to 19 show the manner of operation of a further embodiment of the compaction system.
Figure 13:
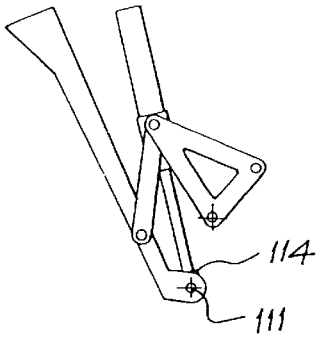
Figure 14:
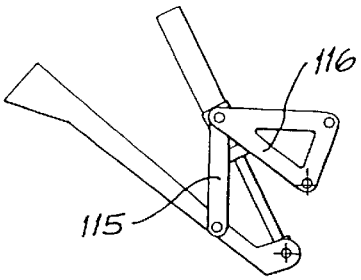
Figure 15:
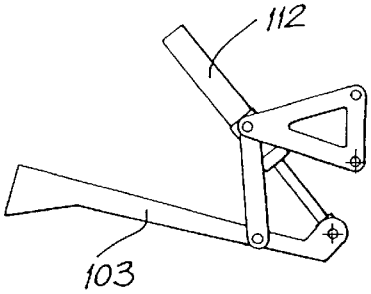
Figure 16:
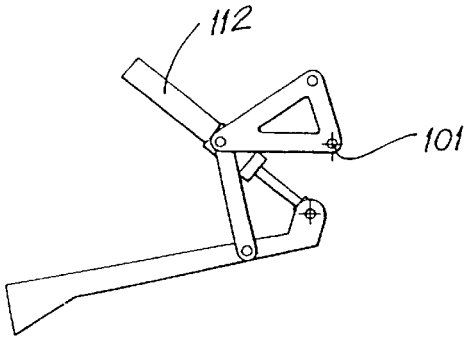
Figure 17:
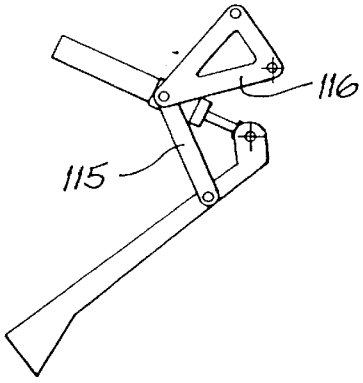
Figure 18:
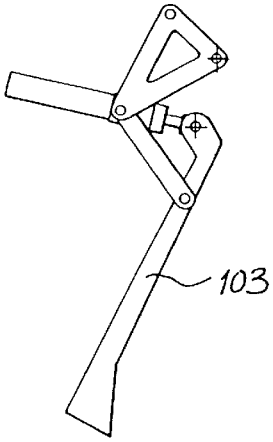
Figure 19:
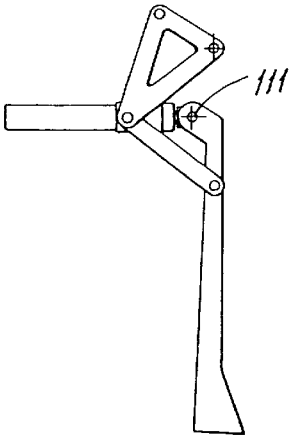

The compaction blade 13 is designed in such a way that there is quite a large clearance around the three sweeping sides. This gap allows a certain amount of product to bypass around the edges of the blade, particularly under high compaction forces. This bypass product, however, is scraped off the back of the compaction blade as it is rotated back out of the container by three, closely toleranced, angled cutter bars 21 which are fixed to the inside of the container just under the opening (see FIG. 7).

The lid 12 which is normally left in the closed position to seal the container 11is opened for loading of waste product. Once the product has been deposited into the container, the lid is closed and latched manually by lip clamps 22.

Once the clamps 22 are securely in place, a locking bar 23 engages two proximity switches 24 thus allowing the compaction electrical circuit to be completed. This feature prevents the compactor from working unless the lid is safely closed and locked into position.

The design of the compaction chamber allows the container and compaction blade to be segmented with each panel operating independently. This feature allows for multiple products such as recyclables to be separated and compacted individually. In this configuration the lid is also divided and operated individually for independent discharge facilities.

The compactor 10 may be fitted with an integral bin loading device 30 (see FIG. 4) which allows the lifting, tipping and discharge of conventional mobile garbage bins. The container location bar 31 permits the unit to lift 120–660 litre containers and to discharge at any position along the width of the compactor thereby improving the load distribution. This location bar 31 also allows two or three mobile bins to be loaded simultaneously.

The bins are hooked onto the location bar and a mechanical clamp is applied to ensure that they are securely locked in place during the discharge operation. The loader can, optionally, open the lid of the compactor automatically when lifting the bins for discharge.

The loader can be operated from the packer hydraulic power unit. The loader can also be fitted to a non-compacting version of the 3 cubic metre container, in which case the loader would be powered by either a hand pump or a DC power pack.

The compactor with or without bin loading device can be provided in a highly mobile version by the installation of large (trailer type) wheels 40 at the loading side and a steering type jockey wheel 41 and draw bar 42 at the other side. These wheels are installed instead of the small caster type wheels and permit the unit to be easily moved by hand using the draw-bar which has an integral safety-brake. The unit can also be towed by a motor vehicle using a towball attachment on the draw-bar. This draw-bar is designed to fold out of the way during loading by the collection vehicle.

The refuse compactor 100 shown in FIGS. 10 to 19 includes a storage/compaction chamber 101, a lid 102 and a compaction blade 103.

In this instance, the storage/compaction chamber 101 is nominally of 3 cubic metre capacity and has an opening 104 thereto for loading and discharge of the waste products.

The storage/compaction chamber 101 is normally constructed from light gauge sheet steel which is fully welded to provide a completely sealed and therefore leakproof container. Optionally, the steel chamber 101 may be galvanised for added protection, but it can be constructed from other materials such as stainless steel, fibreglass or high impact plastic depending on the applicational requirements.

The storage/compaction chamber 101 is normally constructed in with semi-circular walls 105 and flat sides 106. This shape simplifies the fabrication process, reduces the number of corners where rust could occur and promotes easy discharge of the product when the container is inverted to be emptied. The side profiles of the storage/compaction chamber 101 are tapered to allow the base containers to be stacked inside each other, thereby reducing the shipping/transportation costs.

The side plates 106 have lifting sockets 107, pivot bearings 108 and cylinder devices 109. Lifter mounts are attached when the compactor is assembled at its destination.

The storage/compaction chamber 101 can be fitted with castor type wheels 110 to permit the compactor to move around by hand. For some applications larger wheels and a draw bar can be fitted to allow the compactor to move more easily.

The storage/compaction container 101 can be produced in a range of alternative sizes and shapes, depending on the applicational requirements.

The compaction blade 103, is hydraulically powered, about a pivot point 108 to move through an arc of travel to compact the waste product into the chamber 101. The compaction blade 103 is fixed to a torque tube 111 which is supported by bearings at each end of the storage/compaction and is powered by a variation of actuator formats to provide specific benefits for specific applications.

The normal format of compaction blade 103 actuation uses twin hydraulic cylinders 109 which are mounted externally to each side-plate 106 and drive the torque tube 111 via crank arms 113. This format offers a low cost method of actuation but has the disadvantages of limited effective rotational ability (120 degrees), poor cylinder protection and can only drive a one-piece compaction plate. As the rod of cylinder 109 is extended or retracted the crank arm 113, torque tube 111 and compaction blade 103 are rotated about the pivot bearings 108.

Another compaction format which is shown in FIGS. 12 to 19 uses one or more cylinders 112 which mount to the torque tube 111 via the rod clevis 114. Twin mechanical linkages 115 and 116 connect the barrel 113 of the cylinder 112 to the compaction blade 103 on one side and the body of the storage/compaction container 101 on the other. This format permits a greater effective rotational ability (up to 270 degrees), good cylinder protection because they are enclosed within the compactor body and the ability to individually drive segments of the compaction plate. As the rod of cylinder 112 is retracted the link arms 115 and 116 are forced apart causing the compaction blade 103 to rotate about the torque tube bearings.

Figure 20:
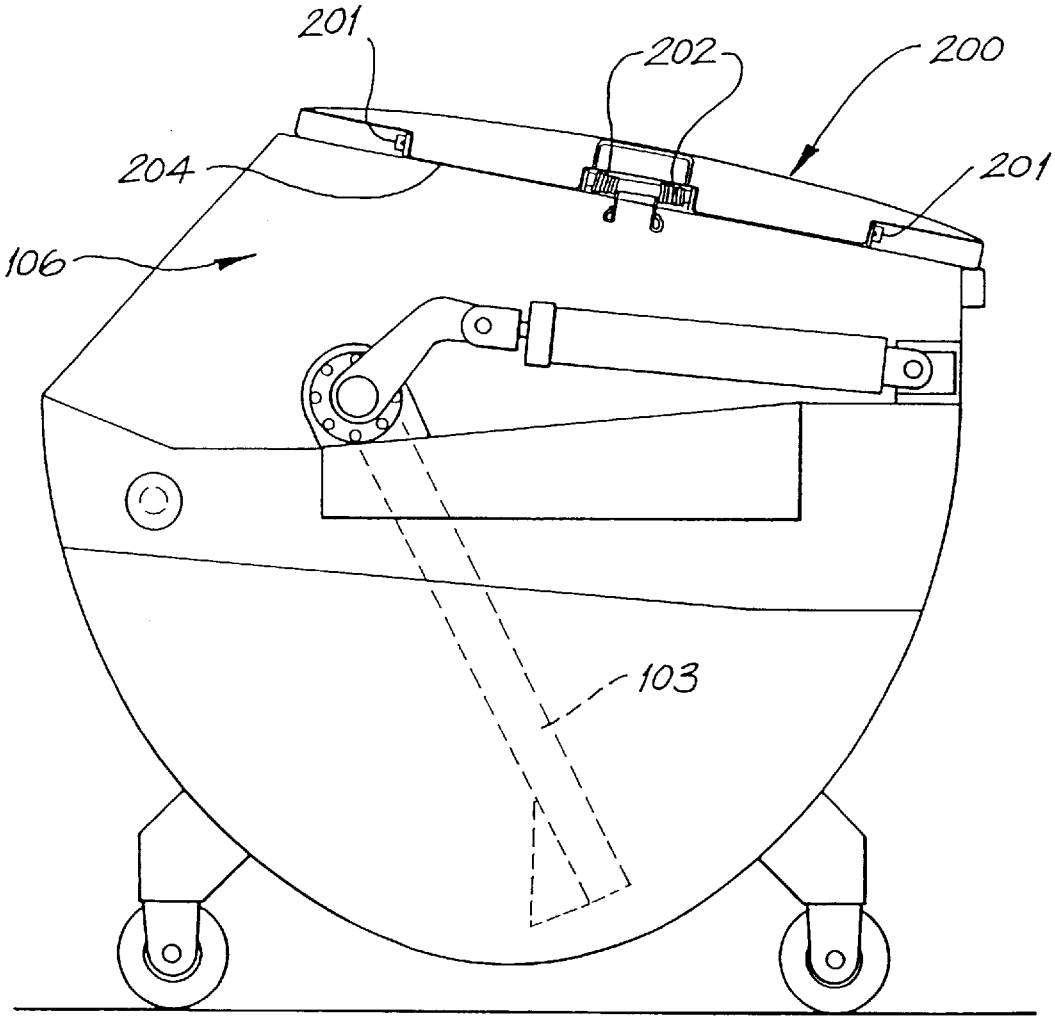
FIG. 20 is a side-elevational view of a refuse compactor according to a third embodiment of the invention.

The embodiment shown in FIG. 20 has twin, high impact plastic, lids 200 which are attached to each side plate 106 of the compactor via hinges 201. As the compaction blade 103 is rotated upwards it contacts the lids 200 and mechanically open the doors to allow access. The lids are biased by springs 202 to ensure that they close automatically as the compaction blade 103 is rotated downwards. A seal 204 fitted to the bottom of each lid 200 ensures that the lids seal the weather out and the odours in.

In another embodiment a single, high impact plastic, lid is hinged at the rear of the opening to the storage/compaction body. Again, in this embodiment the door is opened mechanically by the upward travel of the compaction plate and closed automatically by spring assistance.

The lids can be manufactured from other materials, including clear plastics and light weight steel or aluminium.

The compaction plate movement is controlled by means of positional sensors with an over-ride by pressure sensors to prevent stalling. The compaction plate is normally stored in the fully pressed position, thereby holding the product compressed and reducing the action of spring-back. In this position the hopper lids are closed and the unit is sealed, preventing water from entering or odours from escaping.

To operate the computer, the "Open" buttons are depressed and the cylinders operate to rotate the compaction plate upwards to the open position. As the plate contacts the hopper lids, they are forced open allowing access for loading. A positional switch turns the system off once it has reached the "Full Open" position. Once the compaction chamber has been filled, the "Pack" buttons are depressed and the compaction plate is allowed to close, at a controlled rate, under gravity until the hopper doors have been closed completely. At this, hydraulic power is applied to the compaction cylinders and the plate is forced through to the "Fully Packed" position where a positional sensor again turns the machine off. If the product is already packed to such an extent that the plate cannot reach the "Fully Packed" position then a pressure over-ride will detect the excessive load and turn the machine off. An optional indicator can warn the operator of this condition so that he knows that the compactor is almost full.

Under normal conditions, the compaction plate and lids are opened completely prior to collection of the container by the frontloading compacting vehicle. This permits the product to discharge freely from the container when inverted by the collection vehicle.

The compaction cylinders are capable of producing extremely high forces, even at the edge of the blade and therefore can easily achieve compaction ratios in the order of 3 or 4 to 1. The result is that the 3 cubic metre container will hold up to 12 cubic metres of waste product or up to 2.5 tonnes payload.

The compaction system design has paid special attention to the safety aspect of the operation. The hydraulic system is interlocked with a safety switch system which only permits the blade to fall (at a controlled rate) under its own weight until such time as the hopper lid has closed completely. At this time, only, can power be applied to the compaction cylinders. The compactor operation can be controlled from a remote position (out of harms way) or by a two-handed "deadman" control system on the compactor itself. The result is that serious injury is impossible because if there is any obstruction preventing the plastic hopper lid from closing the machine will not operate, thereby providing a truly foolproof, yet simple, safety system.

While the basic compaction module is produced in a 3 cubic metre capacity size, it can easily be manufactured in narrower, wider or longer formats to best suit the application requirements. For the same reason the container can be produced in other shapes, including; a square sided configuration to allow stacking for improved storage efficiencies and round for increased strength for high pressure applications.

The compaction chamber can be divided into multiple compartments by installing divider plates and modifying the compaction plate to provide appropriate individual sections. In this way more than one type of product can be handled by a single unit. This is ideal for multifraction recycling applications and co-mingled general service requirements.

When the "Follower Type" hydraulic cylinder compaction version is used for multifraction compaction, independent cylinders can be fitted to each blade section, thereby allowing totally independent compaction of each type of product.

For applications where compaction is not an advantage, such as incompressible product, the compaction blade can be removed providing a single or multiple compartment solid waste or recyclable products storage container. In this format the storage compartment does not necessarily need to be constructed from steel, thereby allowing the use of less expensive or special purpose materials such as fibreglass, plastics, etc.

The hopper door can also be replaced with a fully sealed lid and internal baffles can be installed, when necessary, thereby allowing the storage container to hold liquids. The construction of the container is strong enough to permit positive pressurisation and vacuum as possible methods of liquid transfer. This version can be used for liquids other than waste product, thereby further enhancing the versatility of the module to encompass applications such as water storage for emergency services and street washing.

For less viscous fluids, such as cement for contaminated waste handling, an internal, helical shape agitator blade can be fitted to mix the product and prevent curing as well as providing an alternative method of emptying of the container. The agitator blade is supported and driven by means of twin hydraulic wheel motors mounted to the side plates of the storage container.

The design means that a simple crane truck and trailer can be used to transport cement to construction sites in 3 cubic metre batches (up to 4 at a time) without the cost and inconvenience of specially designed transit mixer vehicles.

This added advantage of this system is that it allows a number of containers (full of product) to be stored on site until required while being agitated using a separate, self-contained, hydraulic power unit. This system also provides the added benefit that the small storage modules can be handled by a conventional site crane to position the load where it is needed, thereby eliminating the need for expensive truck mounted concrete pumps.

For wet food waste applications the agitator can be incorporated with a steam generator to provide sterilisation of the product whilst in transit. This process allows the product to be fed to some animals rather than disposed of at a landfill.

Various modifications may be made in details or design and construction without departing from the scope and ambit of the invention.

I claim:

1. A refuse compactor comprising:

(i) a storage chamber having an open top through which refuse is loaded and compacted refuse is unloaded, (ii) a lid pivotally mounted on the chamber and movable between an open position clear of the open top to allow refuse to be loaded into the chamber and compacted refuse to be unloaded from the chamber and a closed position in which the lid closes the open top of the chamber, (iii) a rotary compaction blade at or adjacent to the open top which is pivotally mounted on the chamber, the compaction blade being movable from a first position in which it is located clear of the open top and a second position beneath the lid when the lid is closed and a third position within the chamber remote from the open top, the movement of the compaction blade from its second position to its third position acting to compact the refuse in the chamber, (iv) means for pivoting the compaction blade from its second position to its third position, (v) interlock means operative to permit the movement of the compaction blade from its second position to its third position when and only when the lid is closed.

2. A refuse compactor according to claim 1 and including means for locking the lid to the container when the lid is in the closed position.

3. A refuse compactor according to claim 1 wherein the means for pivoting the compaction blade includes a ram and cylinder arrangement connected to the compaction blade.

4. A refuse compactor according to claim 3 wherein the ram and cylinder means is connected between the container and the compaction blade.

5. A refuse compactor according to claim 3 wherein the ram and cylinder means is connected between the lid and the compaction blade.

6. A refuse compactor according to claim 1 and further comprising floor engaging wheels mounted on and supporting the chamber.

7. A refuse compactor according to claim 1 and further comprising wiper blades within the chamber adjacent to the open lid adapted to remove any refuse on the top of the compaction blade as it moves out of the chamber to assume its first position.

8. A refuse compactor according to claim 1 wherein the rotary compaction blade is mounted on a torque tube which extends across the chamber at or adjacent to the open top.

* * * * *